US011168468B2

(12) United States Patent
Kehoe et al.

(10) Patent No.: US 11,168,468 B2
(45) Date of Patent: Nov. 9, 2021

(54) DRAIN CLEANING CABLE

(71) Applicant: MILWAUKEE ELECTRIC TOOL CORPORATION, Brookfield, WI (US)

(72) Inventors: Sean T. Kehoe, Waukesha, WI (US); Justin Miller, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 271 days.

(21) Appl. No.: 16/014,314

(22) Filed: Jun. 21, 2018

(65) Prior Publication Data

US 2018/0369883 A1 Dec. 27, 2018

Related U.S. Application Data

(60) Provisional application No. 62/650,408, filed on Mar. 30, 2018, provisional application No. 62/628,382, filed on Feb. 9, 2018, provisional application No. 62/549,046, filed on Aug. 23, 2017, provisional application No. 62/524,117, filed on Jun. 23, 2017.

(51) Int. Cl.

| | |
|---|---|
| ***E03C 1/302*** | (2006.01) |
| ***B08B 9/045*** | (2006.01) |
| ***E03F 9/00*** | (2006.01) |
| ***B08B 9/043*** | (2006.01) |

(52) U.S. Cl.

CPC ..... *E03C 1/302* (2013.01); *B08B 9/045* (2013.01); *B08B 9/0436* (2013.01); *E03F 9/002* (2013.01); *E03F 9/005* (2013.01)

(58) Field of Classification Search

CPC ..... E03C 1/302; E03F 9/002; E03F 9/005; B08B 9/027; B08B 9/04; B08B 9/043–436; B08B 9/045; B08B 9/047

USPC ..... 15/104.31–104.33

See application file for complete search history.

(56) References Cited

U.S. PATENT DOCUMENTS

| | | | | |
|---|---|---|---|---|
| 1,600,373 A * | 9/1926 | Stremel | E03C 1/302 | 15/104.33 |
| 1,758,504 A * | 5/1930 | English | B25B 27/0028 | 81/8.1 |
| 1,863,460 A * | 6/1932 | Auringer | E03C 1/302 | 15/104.33 |
| 2,158,577 A * | 5/1939 | Haley | E03F 9/002 | 15/104.095 |

(Continued)

FOREIGN PATENT DOCUMENTS

| | | | |
|---|---|---|---|
| CN | 203129280 U | | 8/2013 |
| GB | 818278 | * | 8/1959 |
| IE | 29612512 U1 | | 11/1996 |

*Primary Examiner* — Mark Spisich

(74) *Attorney, Agent, or Firm* — Michael Best & Friedrich LLP

(57) ABSTRACT

A drain cleaning cable for use with a drain cleaner. The drain cleaning cable includes an inner core having a first end and a second end, and an outer wire concentrically surrounding the inner core, where the outer wire is helically wound in a first direction to form a plurality of consecutive coils, and where the outer wire has a first end and a second end. A first connector engages with the first end of the inner core and the first end of the outer wire, where the first connector is configured to attach the drain cleaning cable to a drain cleaning element. The second end of the inner core and the second end of the outer wire are received within the drain cleaner.

20 Claims, 14 Drawing Sheets

(56) References Cited

U.S. PATENT DOCUMENTS

| | | | | | |
|---|---|---|---|---|---|
| 2,244,735 | A * | 6/1941 | Silverman | B08B 9/0436 | 15/104.33 |
| 2,608,421 | A | 8/1952 | Schnepp | | |
| 2,630,590 | A * | 3/1953 | O'Brien | E03F 9/002 | 15/104.33 |
| 2,880,435 | A * | 4/1959 | Deutsch | E03F 9/002 | 15/104.33 |
| 3,118,159 | A | 1/1964 | Kollmann | | |
| 3,397,420 | A * | 8/1968 | Schneider | E03F 9/002 | 15/104.33 |
| 3,457,580 | A * | 7/1969 | Meyers | F28G 3/12 | 15/104.33 |
| 3,694,011 | A * | 9/1972 | Silverman | E03F 9/002 | 403/316 |
| 4,887,929 | A | 12/1989 | Hale | | |
| 5,933,903 | A * | 8/1999 | Irwin | E03F 9/005 | 15/104.33 |
| 2003/0231927 | A1* | 12/2003 | Hale | B08B 9/045 | 403/349 |
| 2009/0083915 | A1* | 4/2009 | Cicchelli | B08B 9/045 | 15/3 |

* cited by examiner

DRAIN CLEANING CABLE

CROSS-REFERENCE TO RELATED APPLICATIONS

The present application claims priority to U.S. Provisional Patent Application No. 62/524,117, filed Jun. 23, 2017; U.S. Provisional Patent Application No. 62/549,046, filed Aug. 23, 2017; U.S. Provisional Patent Application No. 62/628,382, filed Feb. 9, 2018; and U.S. Provisional Patent Application No. 62/650,408, filed Mar. 30, 2018. The entire contents of these provisional patent applications are each incorporated by reference herein.

FIELD OF INVENTION

The present invention relates to drain cleaning devices and, more particularly, to drain cleaning cables.

BACKGROUND

Drain cleaners and drain uncloggers are generally known, and typically include an elongated cable or snake that is inserted into a drain. The snake is used to collect debris, such as hair, dirt, and other material, that is caught in the drain causing fluid back up. Generally the snake is extended into the drain and is twisted or rotated in order to collect the debris on the end of the snake. Once the debris attaches to the snake, the snake is retracted from the drain, removing the debris with it.

Generally, drain cleaners include a housing having a handle and a motor, a rotatable drum that houses a large cable for cleaning the drain, and a nose assembly that guides the cable into the drain. Rotation of the drum causes rotation of the cable within the drain. The motor drives rotation of the drum and exerts a torque on the snake to break up the clog and collect the debris.

SUMMARY OF THE INVENTION

In one embodiment, the invention provides a drain cleaning cable for use with a drain cleaner. The drain cleaning cable includes an inner core having a first end and a second end, and an outer wire concentrically surrounding the inner core, where the outer wire is helically wound in a first direction to form a plurality of consecutive coils, and where the outer wire has a first end and a second end. A first connector engages with the first end of the inner core and the first end of the outer wire. The first connector is configured to attach the drain cleaning cable to a drain cleaning element. The second end of the inner core and the second end of the outer wire are received within the drain cleaner.

In another embodiment, the invention provides, a drain cleaning cable for use with a drain cleaner. The drain cleaning cable includes a wire helically wound to form a plurality of consecutive coils, where the wire includes a first end having a working implement configured to break up a drain clog and a second end configured to be received within the drain cleaner. The wire has an outer wall defining an outer diameter and an inner wall defining an inner diameter. The wire has a solid section between the inner wall and the outer wall and a hollow section radially inward of the inner wall.

In another embodiment, the invention provides, a drain cleaning cable for use with a drain cleaner including a rotatable drum. The drain cleaning cable includes a wire helically wound to form a plurality of consecutive coils, where the wire includes a first end having a first working implement configured to break up a drain clog and a second end having a second working implement configured to break up a drain clog. The drain cleaning cable is adjustable between a first orientation and a second orientation. In the first orientation the first working implement is configured to be inserted into a drain and the second working implement is configured to be received within the rotatable drum of the drain cleaner. In the second orientation the first working implement is configured to be received within the rotatable drum of the drain cleaner and the second working implement is configure to be inserted into a drain.

In another embodiment, the invention provides a method of manufacturing a drain cleaning cable for use with a drain cleaner. The method includes winding a wire in a helical pattern to form a spring having a plurality of consecutive coils, where the plurality of consecutive coils forms a channel extending from a first end to a second end of the spring. The method further includes heat treating the spring to temper the spring, coating the spring with a layer of nickel alloy using an electroless process, inserting a first end of a core wire into the channel of the spring, and securing the core wire within the channel of the spring.

In yet another embodiment, the invention provides a method of manufacturing a drain cleaning cable for use with a drain cleaner. The method includes winding a wire in a helical pattern to form a spring having a plurality of consecutive coils, where the plurality of consecutive coils forms a channel extending from a first end to a second end of the spring. The method further includes positioning a sleeve on the core wire at a distance inward from a first end of the core wire, crimping the sleeve onto the core using a crimping tool, and inserting the core wire into the channel of the spring by threading the first end of the core wire through the channel from the first end of the spring towards the second end of the spring until the sleeve abuts a narrow portion of the spring. The method further includes securing the core wire within the channel of the spring by pressing a rivet over an opening in the second end of the spring.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
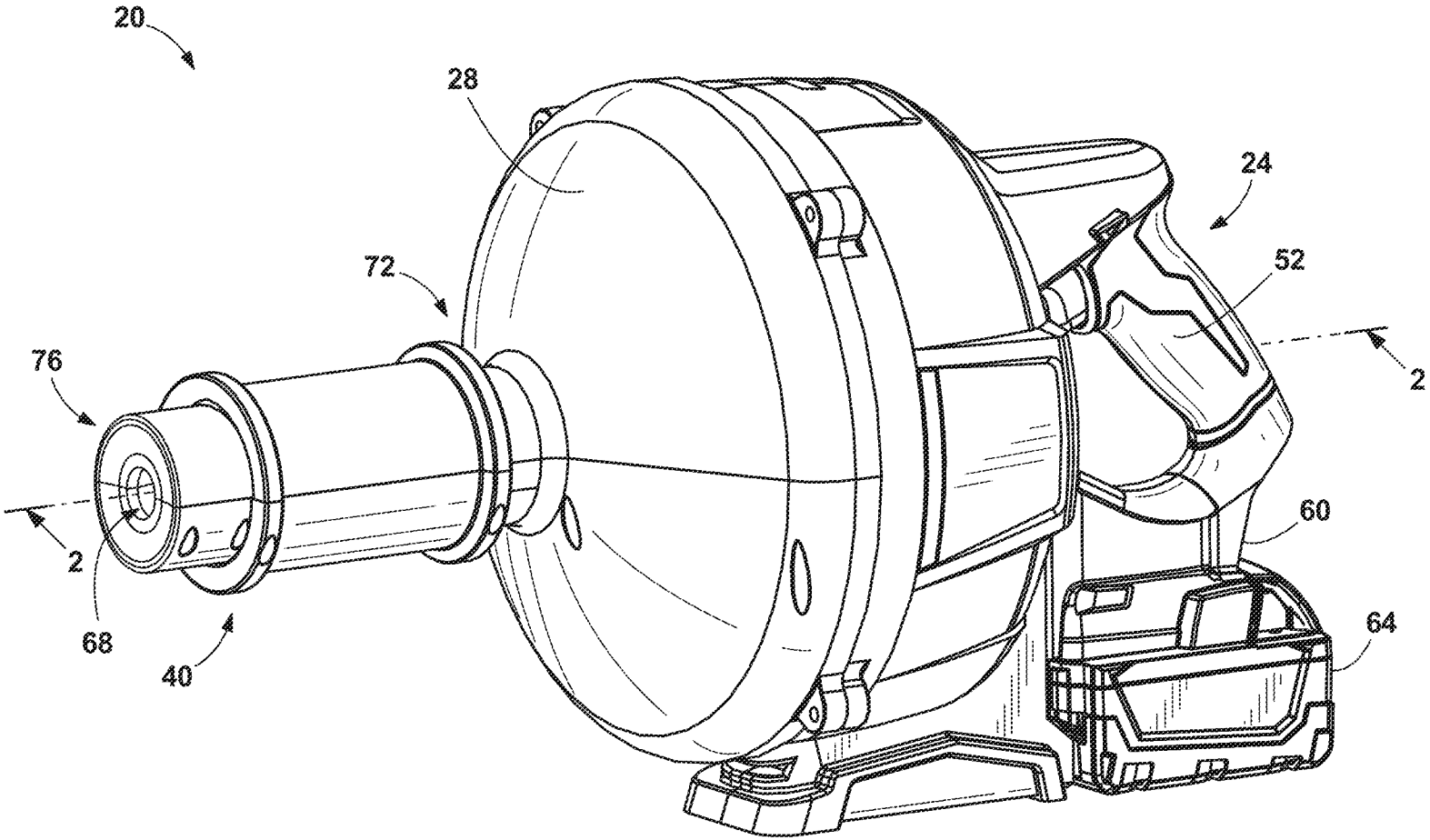
FIG. 1 is a perspective view of a drain cleaner according to one embodiment.
Figure 2:
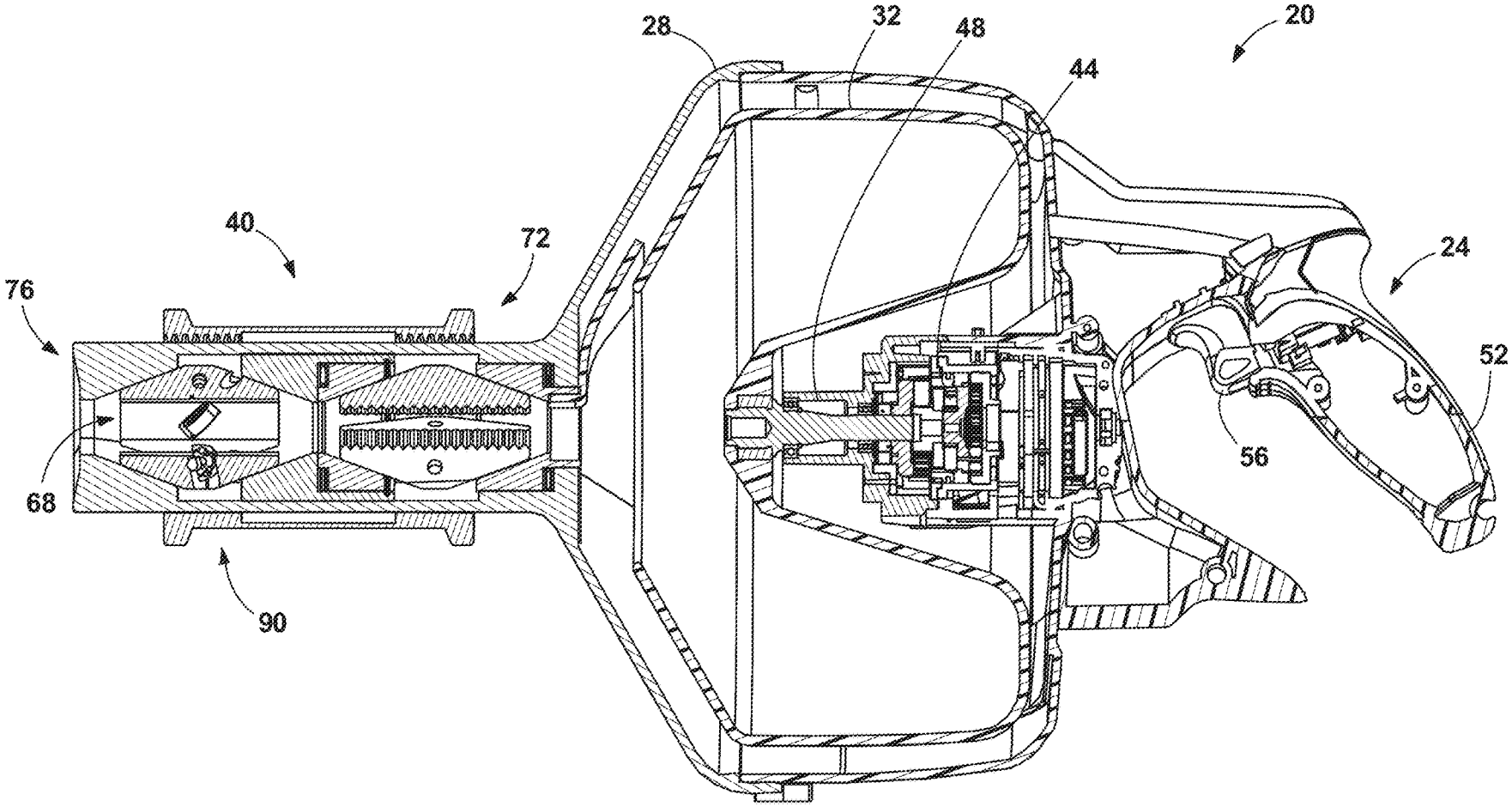
FIG. 2 is a cross-section of the drain cleaner taken along section line 2-2 of FIG. 1.

FIGS. 1-2 illustrate a drain cleaner 20. The illustrated drain cleaner 20 includes a handle assembly 24, a shroud 28, a drum 32, a flexible cable 36 (FIG. 6), and a nose assembly 40. The drain cleaner 20 also includes a motor 44 and a drive mechanism 48 for rotating the drum 32. The flexible cable 36 that is stored within the drum 32 and extends out of the nose assembly 40. The cable 36 is insertable into a drain, or other conduit, for cleaning the drain. The illustrated cable 36 is formed similar to a spring in which a long wire is shaped into a helix. The helical pattern helps to grip debris. The pitch of the helix determines how tight or loose the cable 36 is and whether there is any space between each turn of the helix. In some embodiments, the cable 36 may include an auger head or other tool working implement 124 at its distal end.

The handle assembly 24 extends rearwardly from the shroud 28. The handle assembly 24 includes a grip 52 that is configured to be grasped by a user for carrying and operating the drain cleaner 20. The handle assembly 24 supports an actuator 56 (e.g., a trigger) adjacent the grip 52. The actuator 56 is actuatable (e.g., depressible) by a user to selectively energize the motor 44 and, thereby, operate the drain cleaner 20. The illustrated handle assembly 24 also includes a battery receptacle 60 for receiving and supporting a battery pack 64. The battery receptacle 60 includes terminals that electrically connect the battery pack to the motor 44 and the actuator 56. In other embodiments, the handle assembly 24 may support a power cord to electrically connect the motor 44 to an AC power source.

The shroud 28 is fixedly coupled to the handle assembly 24 such that the shroud 28 is stationary (i.e., does not rotate or otherwise move) relative to the handle assembly 24 during operation of the drain cleaner 20. The shroud 28 is positioned around the drum 32 to help protect the drum 32. Further, the shroud 28 protects a user from the spinning drum 32, and provides ease of use if the user supports the drain cleaner 20 with his/her body during operation (e.g., rests the drain cleaner 20 on a knee or hip). As shown in FIG. 2, the drum 32 is positioned substantially within the shroud 28. The drum 32 is configured to rotate within the shroud 28. The drum 32 is coupled to the drive mechanism 48 such that rotation of the motor 44 is transmitted to the drum 32 through the drive mechanism 48. The drum 32 may be coupled to the drive mechanism 48 using any suitable means to transmit force (e.g., rotation) from the drive mechanism 48 to the drum 32. Rotation of the drum 32 results in rotation of the cable 36. Specifically, in the illustrated embodiment, friction between the inner surface of the drum 32 and the cable 36 causes the cable 36 to rotate or spin with the drum 32.

The nose assembly 40 extends from the shroud 28 in a direction away from the handle assembly 24. More specifically, the nose assembly 24 extends from a first end 72 that is proximal to the shroud 28 to a second end 76 that is distal from the shroud 28. In the illustrated embodiment, the nose assembly 40 is elongated and has a generally cylindrical shape. The nose assembly 40 has a partially hollow interior that creates a passageway 68 for receiving the cable 36. The nose assembly 40 guides the cable 36 from the drum 32, where the cable 36 is coiled, through the passageway 68, and into a drain. The cable 36 is fed into and out of the drain cleaner 20 by a feed mechanism 90.

Figure 4:
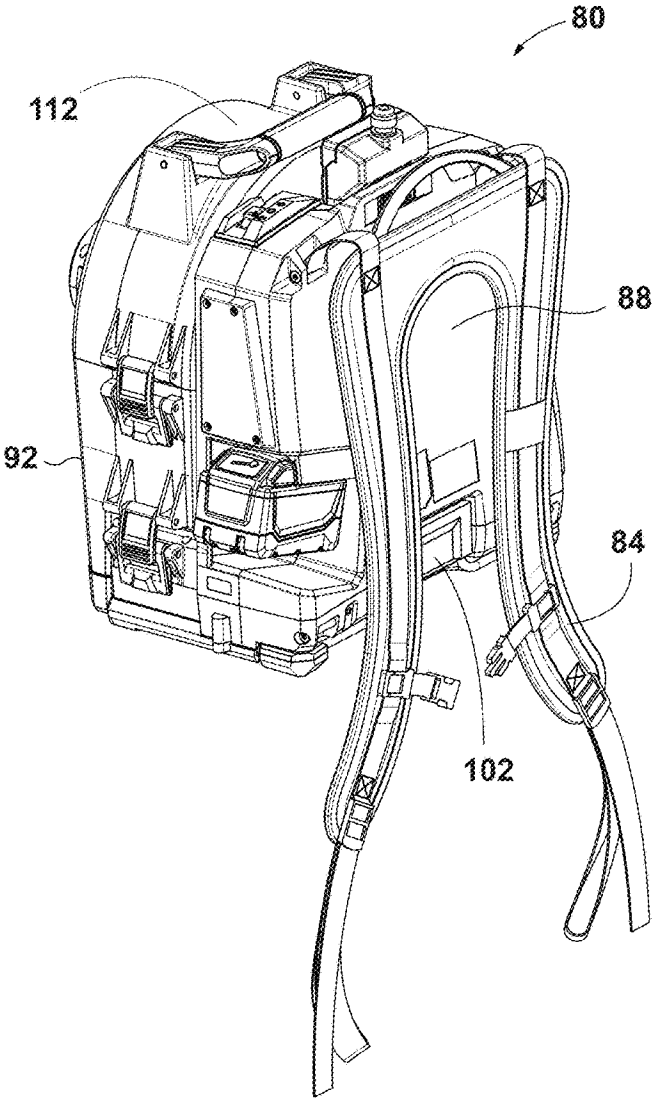
FIG. 4 is a rear perspective view of the drain cleaner shown in FIG. 3.
Figure 3:
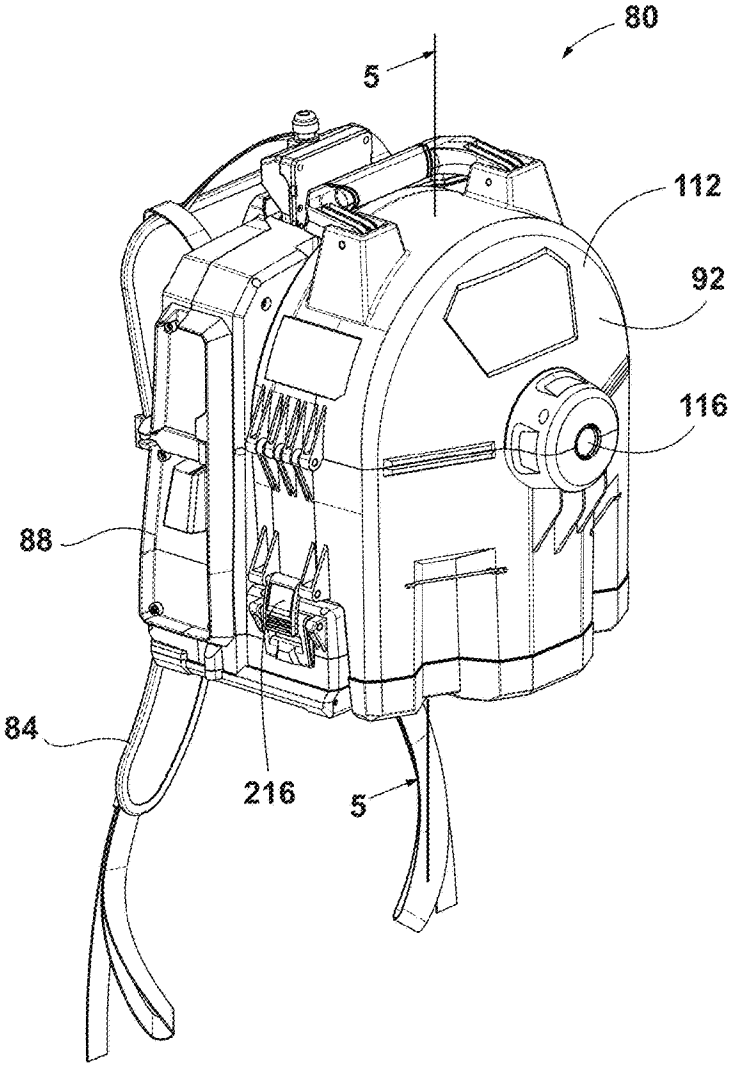
FIG. 3 is a front perspective view of a drain cleaner according to another embodiment.
Figure 5:
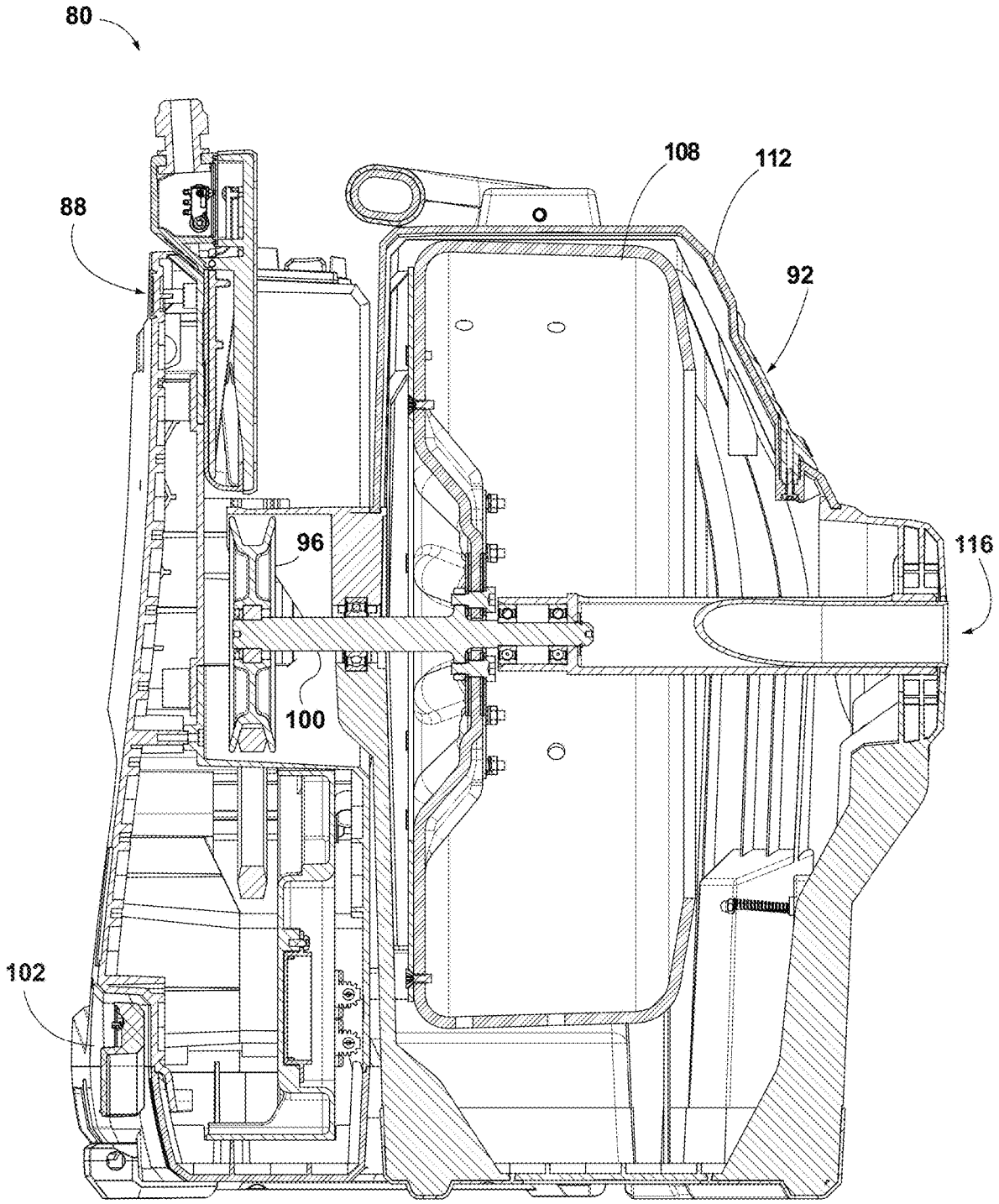
FIG. 5 is a cross-section of the drain cleaner taken along section line 5-5 of FIG. 3.

FIGS. 3-5 illustrate another drain cleaner 80. The illustrated drain cleaner 80 is a freestanding drain cleaner that is supported on the ground (or other suitable surface) during use. In some embodiments, such as the illustrated embodiment, the drain cleaner 80 also includes straps 84 such that the drain cleaner 80 can be carried like a backpack. The drain cleaner 80 includes a base unit 88 and a drum assembly 92. The base unit 88 houses a motor 96, a drive mechanism 100, and a power supply 102 (e.g., a rechargeable power tool battery pack) to power the motor 96. The drum assembly 92 includes a drum 108 and shroud 112 that houses the drum 108. The drive mechanism 100 is operable to rotate the drum 108 within the shroud 112. The drum 108 is configured to house a drain cleaning cable 36, which is fed out of the drum assembly 92 through an opening 116.

Figure 6:
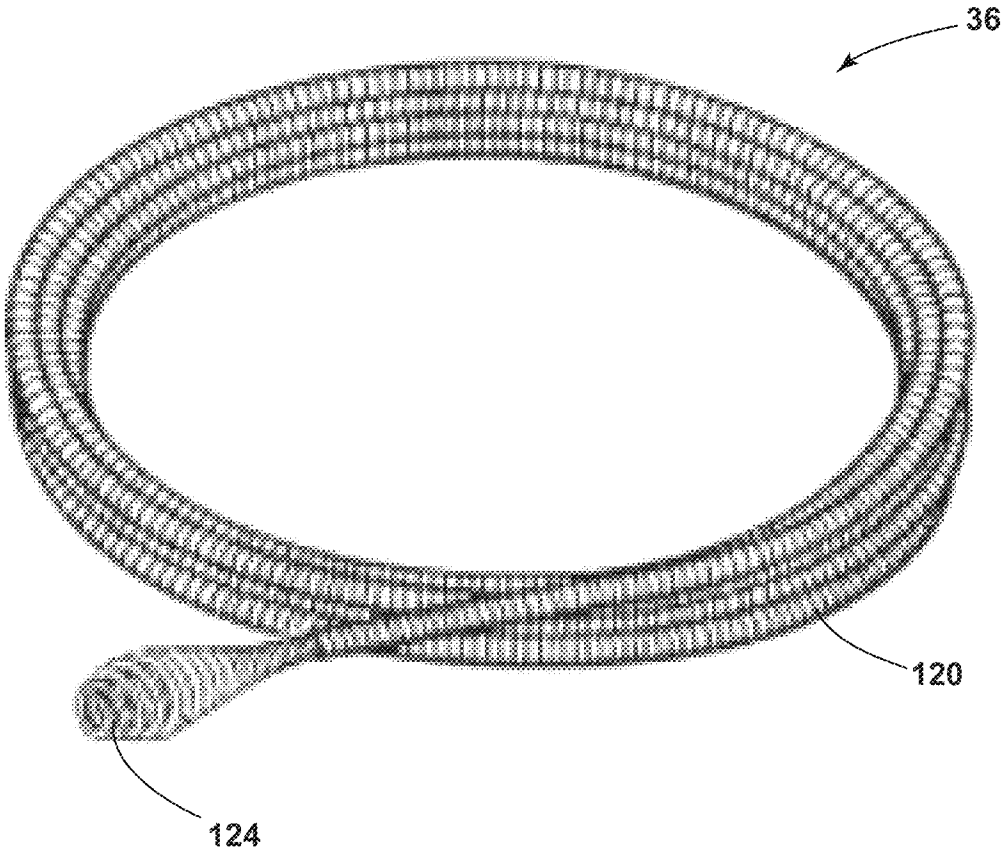
FIG. 6 is a perspective view of a drain cleaning cable for use with a drain cleaner.

FIG. 6 illustrates the drain cleaning cable 36. The cable 36 is formed of a base wire 120 that is wound into an elongated spring. In some embodiments, the base wire 120 may be wrapped around an arbor to form the cable 36. As previously mentioned, when the cable 36 is positioned within a drum (e.g., drum 32, 108) of a drain cleaner (e.g., 20, 80), friction between an inner surface of the drum and an outer surface of the cable 36 causes the cable 36 to spin as the drum rotates. The cable 36 can also be fed into or out of the drum manually (e.g., by pushing or pulling) or by the feed mechanism 90 (e.g., rollers that engage the cable 36 so the cable 36 "threads" forward or backward as the cable 36 spins).

Figure 7:
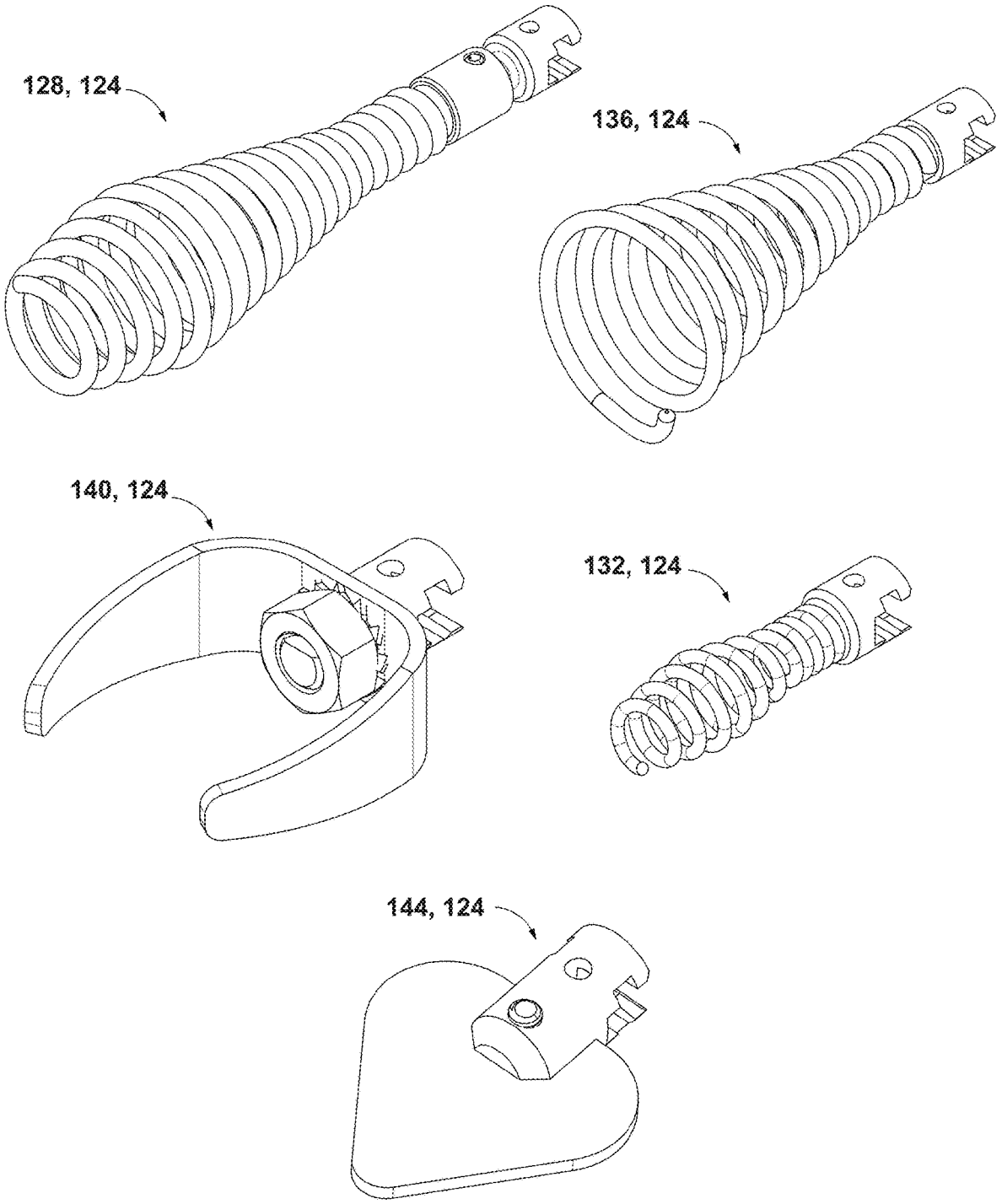
FIG. 7 illustrates a variety of different working implements.

In the illustrated embodiment, the cable 36 includes a working implement 124 at one end of the cable 36 to help break up and/or snag material within a drain or other conduit. In the illustrated embodiment, the working implement 124 is integrally formed on one end of the cable 36. However, in other embodiments, the working implement 124 is a separate element that can be removably coupled to the cable 36. In other embodiments, the cable 36 may include different types of working implements 124 to break up debris or unclog a drain. For example, FIG. 7 illustrates a variety of working implements 124 that can be coupled to or formed at an end of the flexible cable 36. The working implements 124 may be any tool that can be inserted into a drain with the cable 36 to help clean the drain. The illustrated working implements 124 include a large drop head 128, a smaller drop head 132, a bulb head 136, a C-shaped cutter 140, and a spade-shaped cutter 144. Other types of working implements 124 may also or alternatively be connected to the flexible cable.

Drain cleaning cables often experience a large amount of torque from the motor and drum of the drain cleaner, which is needed in order to break up a clog. Therefore, drain cleaning cables are fairly robust and heavy. However, the weight of the cable makes the drain cleaner more difficult to transport between locations, or maneuver during use. Accordingly, it is desirable to create a drain cleaning cable that is strong enough to withstanding large amount of torque, but lighter weight than the standard drain cleaning cable.

Figure 8:
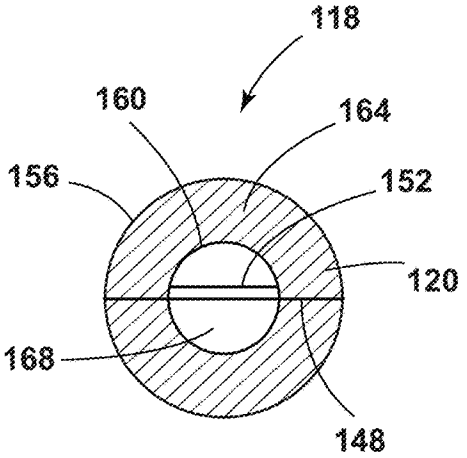
FIG. 8 is a cross-sectional view of a base wire of the drain cleaning cable.
Figure 9:
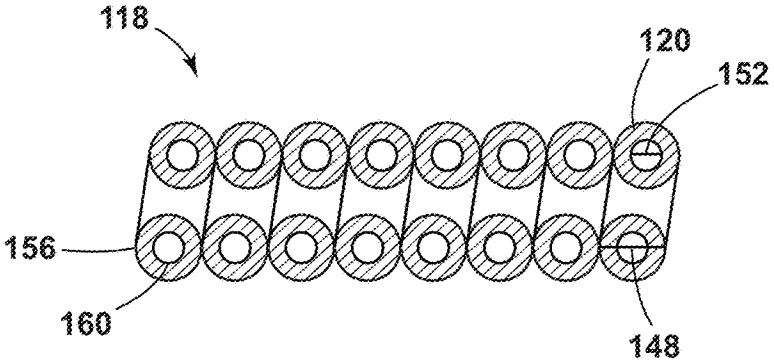
FIG. 9 is a cross-sectional view of a portion of the drain cleaning cable formed with the base wire of FIG. 8.

FIGS. 8 and 9 illustrate one embodiment of a light weight drain cleaning cable 118. The drain cleaning cable 118 is formed by a base wire 120, which is helically wound similar to the cable 36 shown in FIG. 6. The base wire 120 is partially hollow when viewed in cross section. More particularly, a portion of the base wire 120 is removed (or never formed) to reduce the weight of the base wire 120. The base wire 120 has an outer diameter 148 that is measured from an outer wall 156 of the base wire 120. The outer wall 156 forms the outer circumference of the base wire 120. The base wire 120 has an inner diameter 152 that is measured from an inner wall 160 of the base wire 120. The inner wall 160 is disposed radially inward from the outer wall 156. With reference to FIG. 8, when viewed in cross section, the base wire 120 has a solid section 164 between the outer wall 156 and the inner wall 160. The base wire 120 has a hollow section 168 radially inward from the inner wall 160.

In some embodiments, the base wire 120 may be between 10% and 90% hollow (i.e., the inner diameter 152 is between 10% and 90% of the outer diameter 148). In other embodiments, the base wire 120 may be between 25% and 75% hollow (i.e., the inner diameter 152 is between 25% and 75% of the outer diameter 148). In further embodiments, the base wire 120 may be between 30% and 50% hollow (i.e., the inner diameter 152 is between 30% and 50% of the outer diameter 148). In the illustrated embodiment, the base wire 120 is about 30% hollow. The base wire 120 may be formed of, for example, stainless steel hollow syringe stock, ASTM A228 music wire, or other suitable materials.

Figure 10:
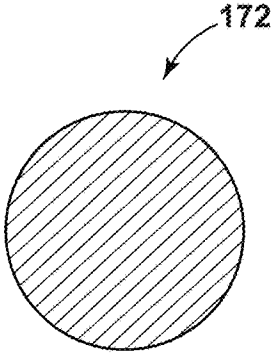
FIG. 10 Prior Art
FIG. 10 is a cross-sectional view of a conventional base wire.
Figure 11:
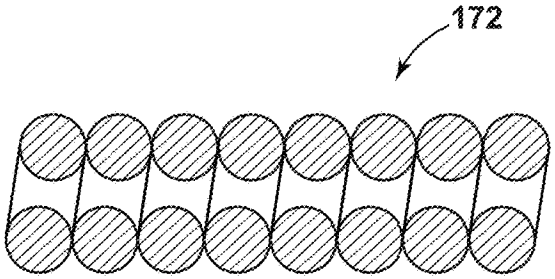
FIG. 11 Prior Art
FIG. 11 is a cross-sectional view of a portion of a drain cleaning cable formed with the conventional base wire of FIG. 10.

In contrast, FIGS. 10 and 11 illustrate a conventional base wire 172 used to form a drain cleaning cable. The conventional base wire 172 is solid in cross-section.

Using the hollow base wire 120 is effective because the drain cleaning cable 118 carries about 90% of its stress through the outer 50% of a cross-sectional diameter of the base wire 120. Making the base wire 120 hollow, therefore, effectively provides the same load carrying capabilities as the conventional solid base wire 172, while reducing the total weight of the drain cleaning cable. For example, a cable that is 25 feet long typically weighs between 40 and 50 pounds. By using the illustrated hollow base wire 120 (i.e., with 30% of the inner diameter removed), the weight of the cable 118 is reduced to 24.5 pounds. In other embodiments, the weight of the cable 118 is reduced to be less than 30 pounds. Such an arrangement increases the portability of the drain cleaning cable 118 and associated drain cleaner 20, 80.

FIGS. 9-11 illustrate a drain cleaning cable 200 for use with a drain cleaner 20, 80 according to another embodiment. The drain cleaning cable 200 includes an open wind sheath that at least partially surrounds an inner core. Specifically, the illustrated drain cleaning cable 200 includes an inner wire 210 and an outer wire 215 that concentrically surrounds the inner wire 210. As shown in FIG. 9, the inner wire 210 is helically wound in a first direction and the outer wire 215 helically wound in a second direction opposite the first direction. For example, in the illustrated embodiment, the inner wire 210 is wound in a right hand direction and the outer wire 215 is wound in a left hand direction. In other embodiments, the inner wire 210 can be wound in a left hand direction and the outer wire 215 can be wound in a right hand direction. In further embodiments, the inner wires 210 and the outer wire 215 can be wound in the same direction (e.g., both in the left hand direction or both in the right hand direction). The outer wire 215 has an open wind in that a gap exists between consecutive turns or coils of the wire 215, rather than being tightly wound like the cable 36 shown in FIG. 4. In the illustrated embodiment, the inner wire 210 also has an open wind with gaps between consecutives turns or coils of the wire 210. In other embodiments, the inner wire 210 may have a closed or tight wind like the cable 36 shown in FIG. 4.

With reference to FIGS. 10 and 11, the inner wire 210 and the outer wire 215 are coupled together by connectors 220. In the illustrated embodiment, a first connector **220*a* engages with a first end 225 of the inner wire 210 and a first end 230 of the outer wire 215. A second connector 220*b* engages with a second end 235 of the inner wire 210 and a second end 240 of the outer wire 215. The connectors 220 include a cylindrical body 245 and a connecting element 250. The connecting element 250 of the first connector 220*a* can be used to attach the drain cleaning cable 200 to the drum of the drain cleaner 20, 80. The connecting element 250 of the second connector 220*b* can be used to attach accessories or working implements 124, such as the working implements 124 shown in FIG. 7, to the end of the cable 200** to help break up clogs and debris in the drain.

In some embodiments, the connecting elements 250 of the first connector **220*a* and the second connector 220*b* are of the same type, while in other embodiments, the connecting elements 250 are of different types. For example, in the illustrated embodiment, the first connector 220*a* is has a female connecting element 250, while the second connector 220*b* has a male connecting element 250**.

The inner wire 210 and outer wire 215 can be coupled to the connectors 220 through a variety of different methods. In some embodiment, the cylindrical body 245 is hollow and forms a bore 255 for receiving the inner wire 210. The cylindrical body 245 of the connector 220 can then be inserted into the outer wire 215 so that the outer wire 215 wraps around an outer circumference 243 of the cylindrical body 245. In this embodiment, the drain cleaning cable 200 can be assembled by stringing the inner wire 210 through the outer wire 215 so that the outer wire 215 surrounds the inner wire 210. This can be done before or after coupling the inner wire 210 to the first connector **220*a***.

FIGS. 10-11 illustrate one method of coupling the inner wire 210 and the outer wire 215 to the connectors 220. The inner wire 210 is coupled to the first connector **220*a* by inserting a first end 225 of the inner wire 210 into the bore 255 of the first connector 220. The first connector 220*a* is then inserted into the first end 230 of the outer wire 215 with the inner wire 210 already coupled to the first connector 220*a*. To couple the inner wire 210 and the outer wire 215 to the second connector 220*b*, the outer wire 215 is compressed (i.e., in an axial direction) to reveal the second end 235 of the inner wire 210. The second end 235 of the inner wire 210 is then inserted into the bore 255 of the second connector 220***b*. Then, the second connector 220*b* is inserted into the second end 240 of the outer wire 215. To insert the second connector 220*b* into the second end 240 of the outer wire 215, the outer wire 215 is stretched (i.e., in an axial direction) so that the second end 240 of the outer wire 215 extends over the second end 235 of the inner wire 210 and onto the cylindrical body 245 of the second connector 220*b*.

Figure 12:
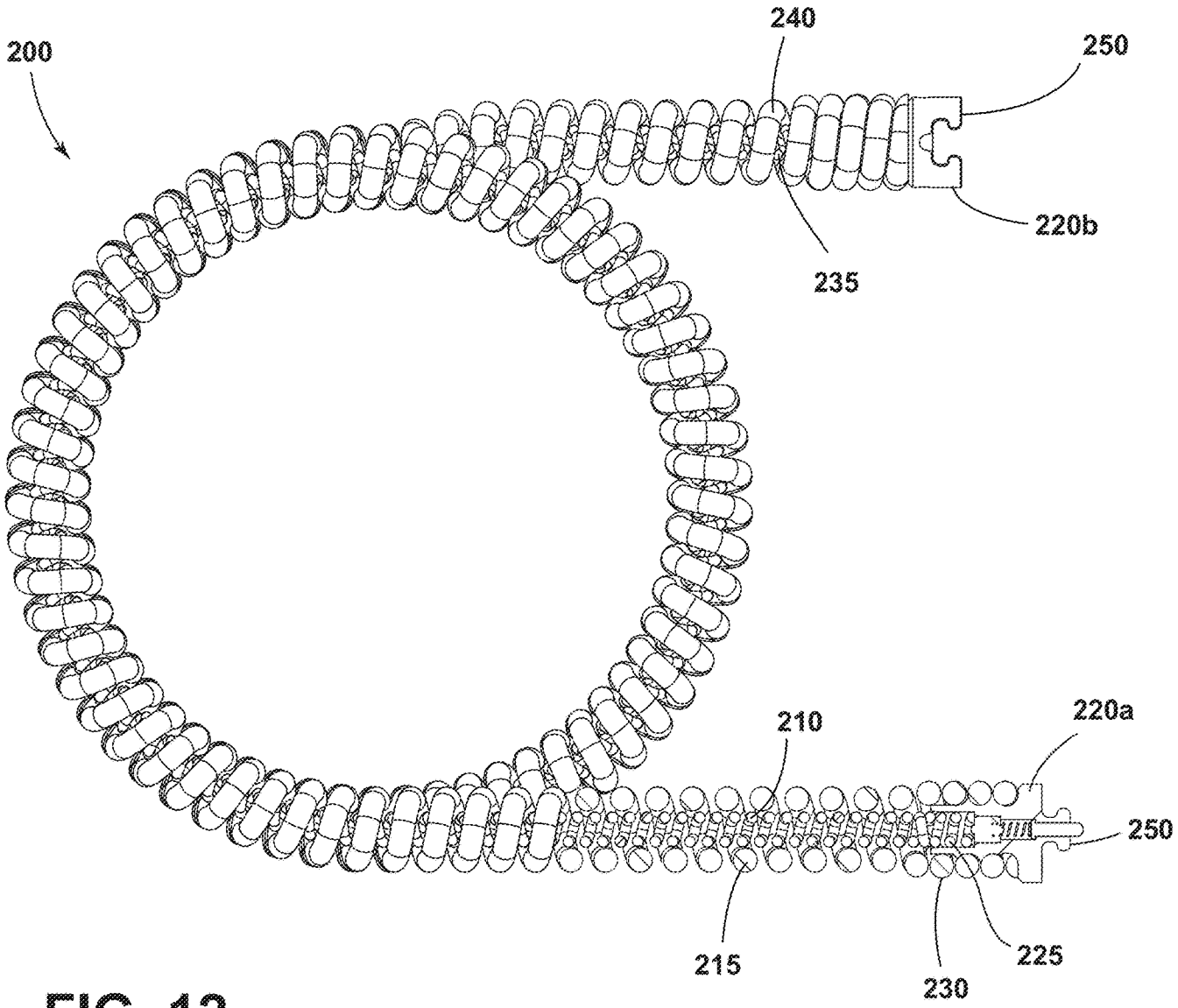
FIG. 12 is a cross-sectional view of another drain cleaning cable.
Figure 14:
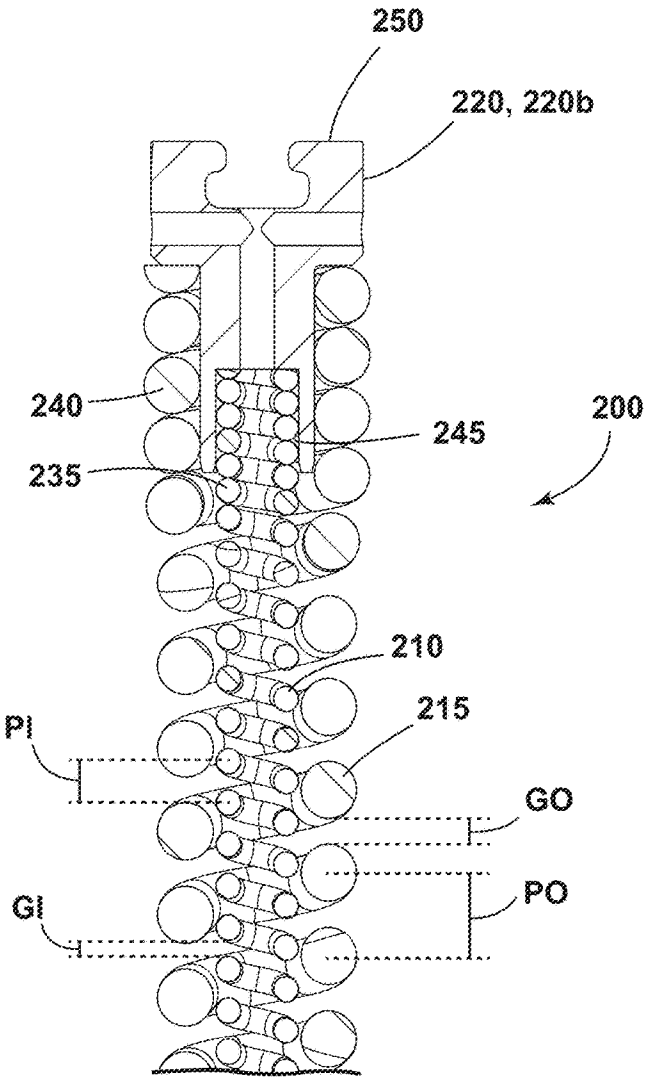
FIG. 14 is a detailed view of a second end of the drain cleaning cable shown in FIG. 12.

In some embodiments, one or both of the bore 255 and the outer circumference 243 of the cylindrical body 245 can include additional working implement 124 features for securing the inner wire 210 and the outer wire 215 to the connector 220. For example, as shown in FIG. 12, the bore 255 may include internal threads 265 for receiving the inner wire 210. In this embodiment, the inner wire 210 is threaded into the bore 255 upon assembly. Similarly, in some embodiments, the outer circumference 243 of the cylindrical body 245 may include external threads 260 to enable the outer wire 215 to be threaded onto the connector 220 during assembly.

Figure 13:
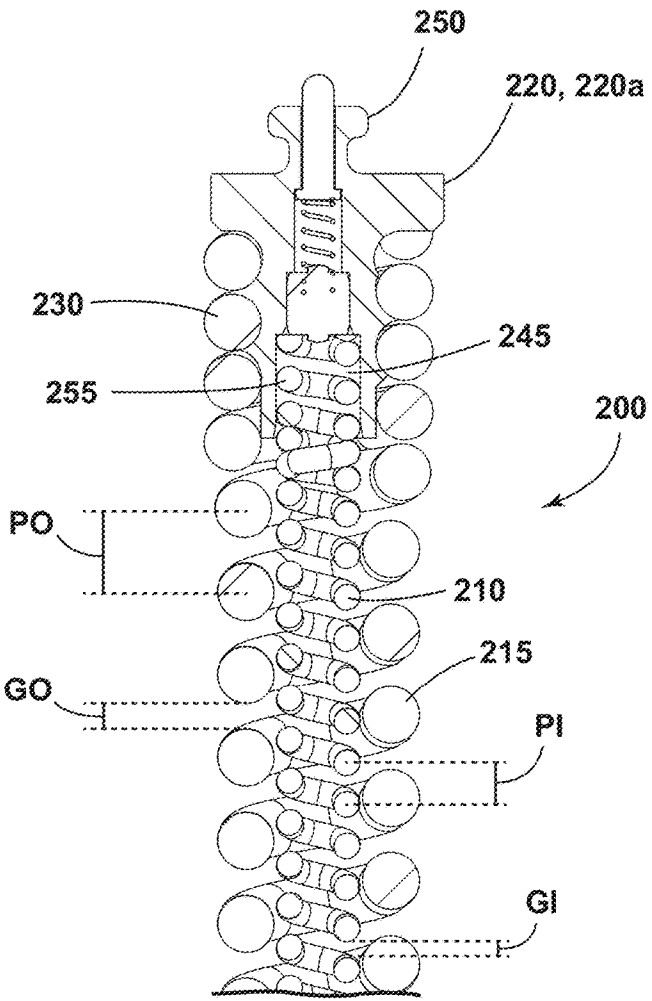
FIG. 13 is a detailed view of a first end of the drain cleaning cable shown in FIG. 12.
Figure 15:
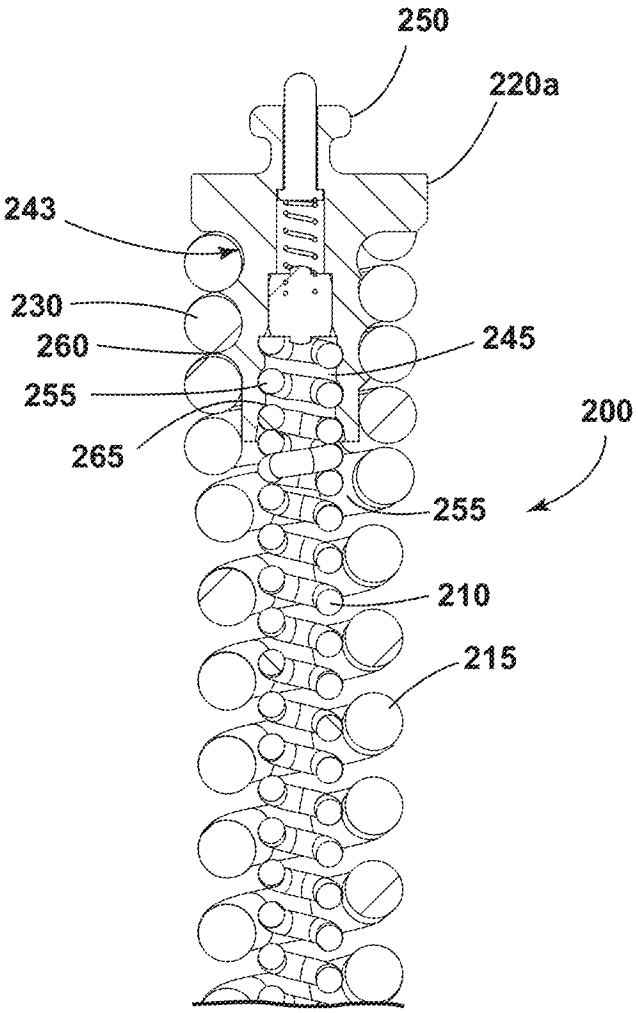
FIG. 15 is a detailed view of a drain cleaning cable with a connector having internal threads and external threads.
Figure 16:
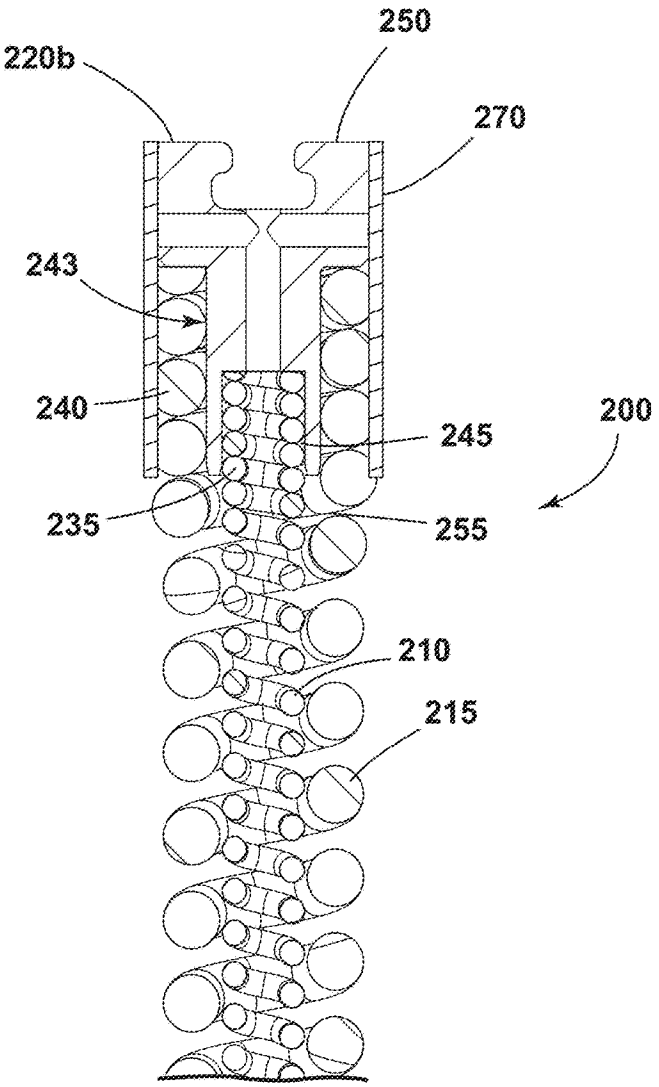
FIG. 16 is a detailed view of a drain cleaning cable with connector having a crimping member.

In some embodiments, one or both of the inner wire 210 and the outer wire 25 may be coupled to the connector 220 by crimping or staking. For example, as shown in FIG. 13, the inner wire 210 may be crimped or staked within the bore 255 of the connector 220. Specifically, the cylindrical body 245 of the connector 220 may be crimped or staked around the inner wire 210. Similarly, the outer wire 215 may be crimped or staked around the outer circumference 243 of the cylindrical body 245. In some embodiments, a crimping member 270 is provided around the outer wire 215 in order to crimp or stake the outer wire 215 to the connector 220. In some embodiments, the inner wire 210 and the outer wire 215 are separately crimped or staked to connector 220. For example, the inner wire 210 may be staked within the bore 255 of the connector 220 prior to stretching the outer wire 215 over the cylindrical body 245 of the connector 220. In other embodiments, the inner wire 210 and the outer wire 215 are crimped to the connector 220 at the same time. For example, the inner wire 210 is inserted into the bore 255 of the cylindrical body 245 and then the cylindrical body 245 is inserted into the outer wire 215 prior to crimping both the inner wire 210 and the outer wire 215 to the connector 220 simultaneously.

In some embodiments, one or both of the inner wire 210 and the outer wire 215 are coupled to the connector 220 through a process of welding or brazing. Welding involves melting a small portion of the elements being coupled together and using the melted material as a binder, whereas brazing involves using filler material as a binder to coupled two different elements together. The inner wire 210 and outer wire 215 may be separately welded or brazed to the connector 220, or may be simultaneously welded or brazed to the connector 220. Alternatively, the inner wire 210 and outer wire 215 may be welded or brazed to one another and the coupled to the connector 220 afterwards.

As will be understood by a person of ordinary skill in the art, the above described methods of coupling the inner wire 210 and the outer wire 215 to the connector 220 may be used in combination with one another. For example, the inner wire 210 may be crimped within the bore 255 of the connector 220 and the outer wire 215 may be welded to the connector 220. Alternatively, multiple methods may be used to couple each wire 210, 215 to the connector 220. For example, the wires 210, 215 may be both threaded and welded to the connector 220. Similarly, the first connector 220*a* and the second connector 220*b* may be coupled to the inner wire 210 and the outer wire 215 in different ways from one another.

With reference to FIGS. 9-14, the illustrated drain cleaning cable 200 provides for a drain cleaning cable 200 with a spring rate and torsional rate at a reduced weight. By providing the drain cleaning cable 200 with less mass, less rotational energy is required to spin the drain cleaning cable 200. Additionally, the construction of the drain cleaning cable 200 allows for fewer turns to be applied to one end of the drain cleaning cable 200 before the outer wire 215 collapses onto one the inner wire 210, and rotation is transmitted from the first end of the drain cleaning cable 200 to the second end of the drain cleaning cable 200. Furthermore, once the inner wire 210 and outer wire 215 collapse onto one another, the drain cleaning cable 200 is less likely to tangle.

The illustrated drain cleaning cable 200 is constructed with a reduced mass as compared with conventional drain cleaning cables. The inner wire 210 and the outer wire 215 may have a certain diameter and/or weight according to different parameters in order to achieve a reduced mass for the drain cleaning cable 200. For example, in some embodiments, the inner wire 210 has a wire diameter between 2 to 4 mm (e.g., 2.7 mm) and the outer wire 215 has a wire diameter of between 4 to 6 mm (e.g., 4.8 mm). In the illustrated embodiment, the inner wire 210 and the outer wire 215 are composed of metal. However, in other embodiments the inner wire 210 and outer wire 215 can be composed of different types of materials or a combination of materials.

Furthermore, in some embodiments, the inner wire 210 weighs between 2 and 10 pounds, and the outer wire 215 weighs between 15 and 30 pounds. In other embodiments, the inner wire 210 weighs between 4 pounds and 7 pounds (e.g., 5.6 pounds), and the outer wire 215 weighs between 20 pounds and 25 pounds (e.g., 23.9 pounds). In the illustrated embodiment, the total weight of the drain cleaning cable 200 is between 25 to 35 pounds per 50 feet of cable 200. Conventional drain cleaning cables weigh about 40-50 pounds per 50 feet of cable 200. Accordingly, the total weight of the drain cleaning cable 200 is reduced by 30% to 50% as compared to conventional drain cleaning cables.

With continued reference to FIGS. 10 and 11, the illustrated drain cleaning cable 200 is also constructed to allow the outer wire 215 to collapse on the inner wire 210 so that the drain cleaning cable 200 becomes solid during torsion. In addition, in some scenarios, the inner wire 210 also expands to meet the outer wire 215 as the outer wire 215 collapses. The inner wire 210 and outer wire 215 are constructed to allow for the outer wire 215 to collapse on the inner wire 210 faster than conventional drain cleaning cables. For example, the inner wire 210 and outer wire 215 may have a pitch, a wind gap, a spring index, a spring rate, and/or torsion rate according to certain parameters. As described herein, the pitch is defined as the height of one complete helix turn, measured parallel to the axis of the wire. The pitch may be measured from the center of the wire. Also, as described herein, the wind gap is defined as the space between consecutive turns or coils of the wire. In other words, two wires may have the same pitch but a different wind gap if the wire diameters are different. For example, if two wires have the same pitch, the wire with the greater wire diameter will have a smaller wind gap.

In some embodiments, the inner wire 210 has a pitch PI of between 2 and 8 mm, and has a wind gap GI of between 1 and 5 mm. In other embodiments, the inner wire 210 has a pitch PI of between 4 and 6 mm (e.g., 5 mm) and a wind gap GI of between 2 and 3 mm (e.g., 2.3 mm). Additionally, in some embodiments, the inner wire 210 has an outer diameter of between 8 to 10 mm (e.g., 8.7 mm). In some embodiments, the parameters of the inner wire 210 may provide for a spring rate of between 0.5 and 1.5 N/mm, and a torsion rate of between 20 and 75 N-mm/rev for a 50 foot cable 200. In other embodiments, the parameters of the inner wire 210 may provide for a spring rate of between 0.7 and 1 N/mm (e.g., 0.8 N/mm), and a torsion rate of between 40 and 60 N-mm/rev (e.g., 55 N-mm/rev) for a 50 foot cable 200. Also, the parameters of the inner wire 210 may provide for a spring index of between 2 and 3.

Likewise, in some embodiments, the outer wire 215 has a pitch PO of between 6 and 12 mm, and has a wind gap GO between 2 and 7 mm. In other embodiments, the outer wire 215 has a pitch PO of between 8 and 10 mm (e.g., 9 mm), and has a wind gap GO of between 3 and 5 mm (e.g., 4 mm). Additionally, in some embodiments, the outer wire 215 has an outer diameter of between 17 to 21 mm (e.g., 19 mm). In some embodiments, the parameters of the outer wire 210 may provide for a spring rate of between 1.0 and 1.4 N/mm, and a torsion rate of between 425 and 475 N-mm/rev for a 50 foot cable 200. In other embodiments, the parameters of the inner wire 210 may provide for a spring rate of between 1.1 and 1.2 N/mm (e.g., 1.17 N/mm) and a torsion rate of between 440 and 460 N-mm/rev (e.g., 450 N-mm/rev) for a 50 foot cable 200. Also, the parameters of the outer wire 215 may provide for a spring index of between 2.75 and 3.

Furthermore, in some embodiments, the combined parameters of the inner wire 210 and the outer wire 215 may provide for a combined spring rate of between 1.8 and 2 N/mm and a combined torsion rate of between 475 and 525 N-mm/rev for a 50 foot cable 200. In other embodiments, the combined parameters of the inner wire 210 and the outer wire 215 provide for a combined spring rate of between 1.9 and 2 N/mm (e.g., 1.97 N/mm) and a combined torsion rate of between 500 and 510 N-mm/rev (e.g., 505 N-mm/rev) for a 50 foot cable 200.

In some embodiments, the cables 200 are heat treated, which relieves stresses from winding to improve durability.

Figure 17:
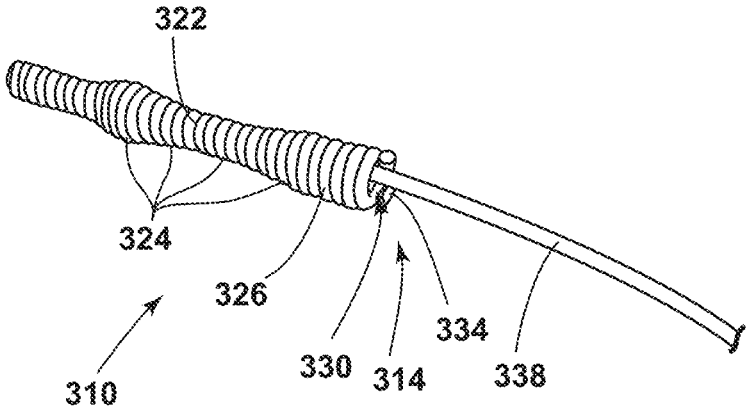
FIG. 17 is a perspective view of a part of a drain cleaning cable according to another embodiment.

FIG. 17 illustrates another embodiment of a drain cleaning cable 310 for use with a drain cleaner 20, 80. The drain cleaning cable 300 includes a first end 314, a second end (not shown) opposite the first end 314, and a wound spring 322 with coils 324 that extend from the first end 314 to the second end. The drain cleaning cable 310 may include a working implement 124 in the form of a bulb 326 on the first end 314 defined by coils 324 of the wound spring 322. The bulb 326 extends radially further outward than the other coils 324 of the cable 310. The bulb 326 assists in removal of debris from a drain or other conduit the drain cleaning cable 310 is inserted into. In other embodiments, the working implement is in the form of one of the working implements 124 shown in FIG. 7.

The illustrated cable 310 also includes a channel 330 defined by an interior of the wound spring 322. The channel 330 extends from the first end 314 of the drain cleaning cable 310 to the second end. An opening 334 is positioned on the first end 314 of the drain cleaning cable 310 to provide access to the channel 330. The channel 330 houses a core 338 that also extends from the first end 314 of the channel 330 to the second end of the cable 310.

In the illustrated embodiment, the wound spring 322 is made by winding a wire in a helical pattern to form the spring 322 having a plurality of consecutive coils 324. In the illustrated embodiment, the spring 322 is made from a steel wire. The spring 322 is then heat treated. In some embodiments, the wound spring 322 is heat treated at about 280 degrees for 30 minutes to temper the spring 322. In other embodiments, the wound spring 322 can be heat treated at a higher or lower temperature for a shorter or longer period of time, as needed for a particular material. In some embodiments, the wound spring 322 is heated treated at a temperature between 250 and 300 degrees. For example, in some embodiments the wound spring 322 can be heated for between 20 and 40 minutes. In further embodiments, the wound spring 322 can be made from other materials or combinations of materials, such as copper, aluminum, alloys, brass, and the like.

To assemble the drain cleaning cable 310, the wound spring 322 is first heat treated at the conditions mentioned above. Once the wound spring 322 is tempered, the cable 310 is electrolessly nickel plated on both the interior of the spring and an exterior of the spring 322 (i.e., inside and outside of the channel 330). In other words, the cable 310 is coated with a layer of a nickel alloy without the use of electric current allowing for a better coating to be applied to the cable 310. Finally, the core 338 is inserted into the channel 330 of the drain cleaning cable 310 through the opening 334. In the illustrated embodiment, the core 338 is made out of nylon. In other embodiments, the core 338 can be made out of other materials or combinations of materials, such as high density polyethylene. The core 338 is then secured within the channel 330 of the spring 322.

Figure 18:
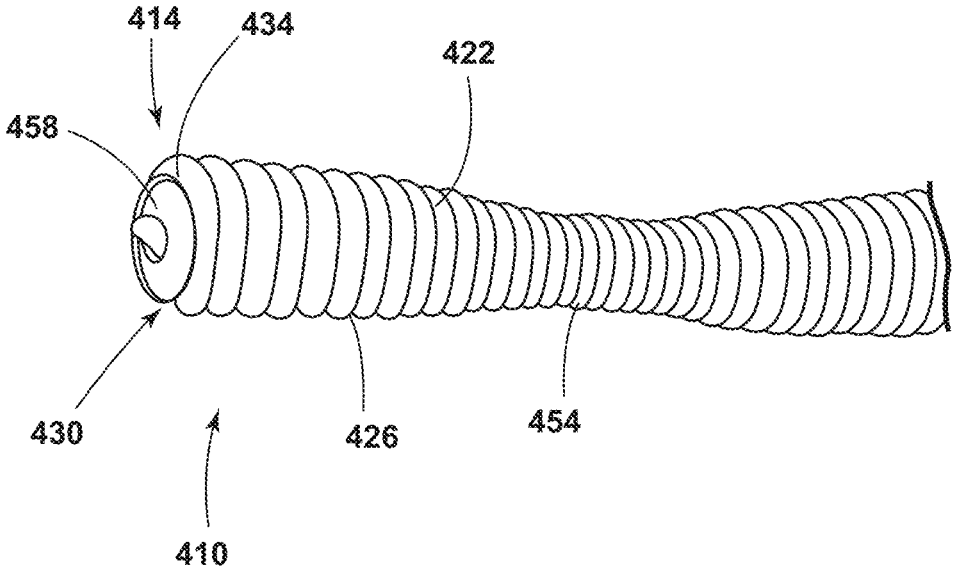
FIG. 18 is a perspective view of part of a drain cleaning cable according to another embodiment of the invention.
Figure 19:
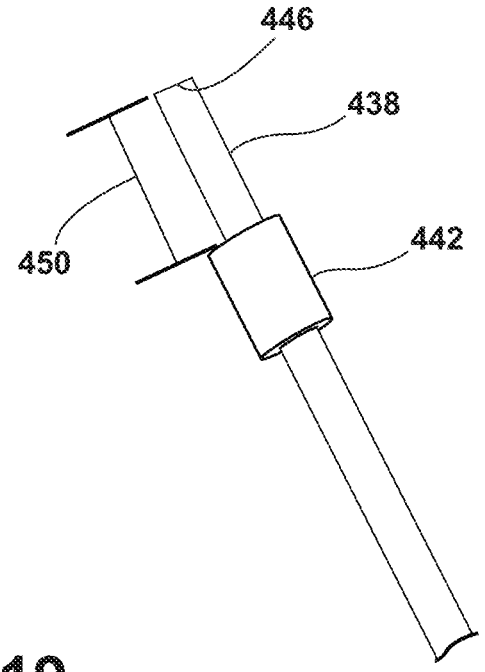
FIG. 19 is a perspective view of a core of the drain cleaning cable of FIG. 18.
Figure 20:
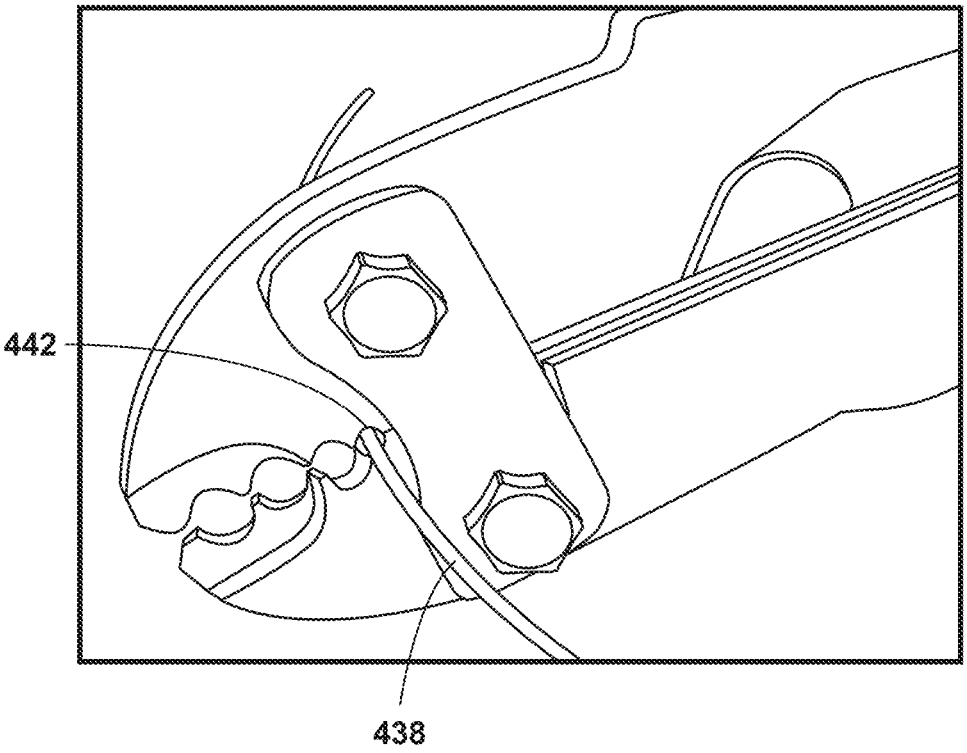
FIG. 20 is a perspective view of a crimping tool crimping a sleeve onto the core shown in FIG. 19.

FIGS. 18-20 illustrate another drain cleaning cable 410 for use with the drain cleaner 20, 80 and a method of securing a core within a channel of a spring. The drain cleaning cable 410 provides a method for improved core retention within the cable 410. Similar to the drain cleaning cable 310 described above, the illustrated drain cleaning cable 410 includes a first end 414, a second end opposite the first end 414, a spring wound coil 422, a working implement in the form of a bulb 426, a channel 430, an opening 434, and a core 438. The drain cleaning cable 410 differs from the drain cleaning cable 310 in that the core 438 includes a sleeve 442 near one end 446.

To assemble the drain cleaning cable 410, a similar heat treating and coating process, as described above, may be used to temper and coat the wound spring 422. The sleeve 442 is then positioned on the end 446 of the core 438 a distance 450 inward from the end 446 (FIG. 19). The distance 450 from the end 446 to the sleeve 442 may be within a range from about one-eighth inch to about two inches. In the illustrated embodiment, the sleeve 442 is made of aluminum. In other embodiments, the sleeve 442 can be made from other suitable materials or combinations of materials, such as steel, brass, and the like.

As shown in FIG. 19, a user can crimp the sleeve 442 onto the core 438 using a crimp tool or other device. Next, the core 438 is placed in the channel 430 of the wound spring 422 by threading a free end of the core 438 into the opening 434. A user can then push the core 438 from the first end 414 of the cable 410 to the second end. As the free end of the core 438 nears the second end of the cable 410, the sleeve 442 abuts a narrow portion 454 inside of the channel 430 proximate the first end 414 of the cable 410 to inhibit the sleeve 442, and thereby the core 438, from extending further into the channel 430. As shown in FIG. 2, a rivet 458 is then pressed over the opening 434 of the cable 410 to trap the core 438 in the channel 430. In some embodiments, the rivet 458 may be secured to the spring 422 by a friction fit, welding, adhesives, and the like.

Figure 21:
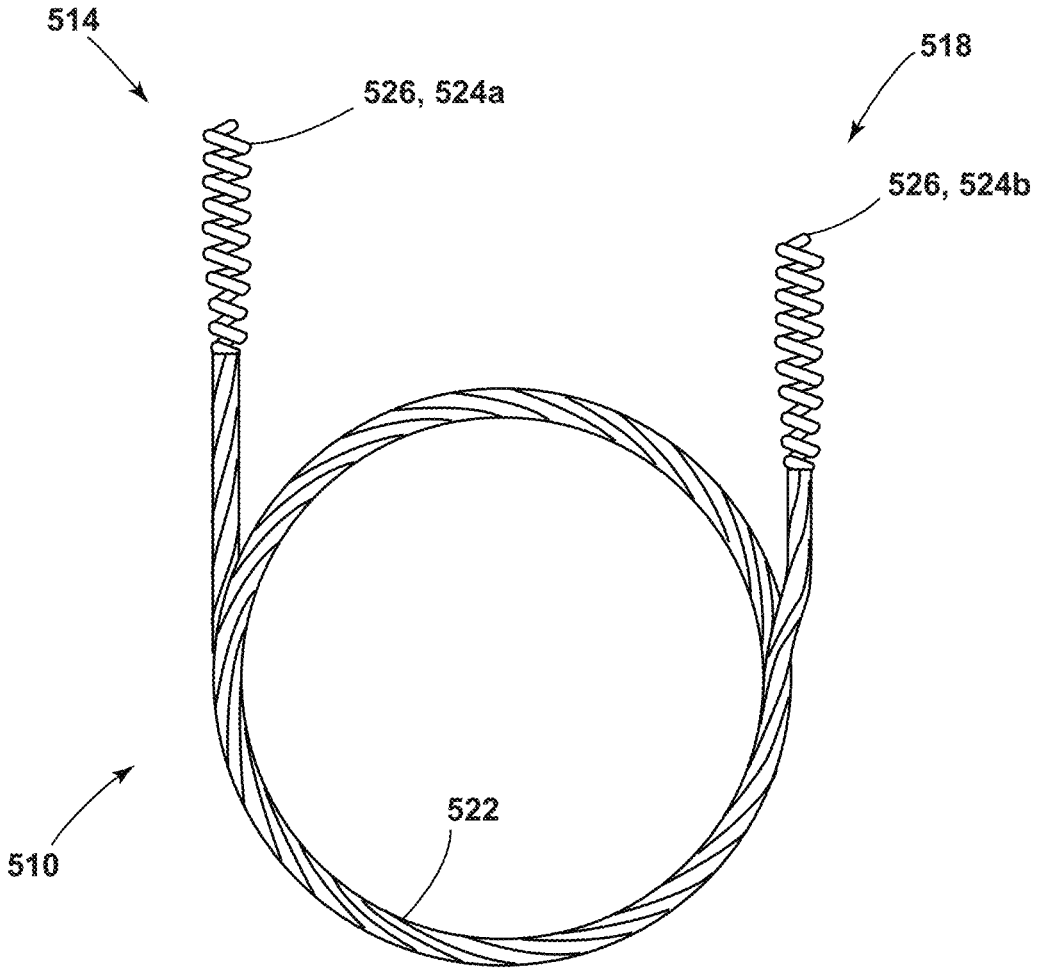
FIG. 21 is a side view of a drain cleaning cable according to another embodiment.

With reference to FIG. 21, another drain cleaning cable 510 for use with the drain cleaner 20, 80 is illustrated. The drain cleaning cable 510 includes a wire that is wound into coils 522. The drain cleaning cable 510 is similar to the drain cleaning cable 310 described above, but includes a working implement 524 on each end of the cable 510. Specifically, the drain cleaning cable 510 includes a first end 514 with a first working implement 524*a* and a second end 518 with a second working implement 524*b*. In the illustrated embodiment, the working implements 524 are in the form of bulbs 526. However, in other embodiments, the working implements 524 can be in the form of any of the working implements 124 shown in FIG. 7. In the illustrated embodiment, the working implements 524 on the first end 514 and the second end 518 are of the same type, specifically, bulbs 526. In other embodiments, the working implement 524*a* on the first end 514 of the cable 510 may be a different type than the working implement 524*b* on the second end 518. Additionally, in some embodiments, the working implements 524 may be integrally formed with the drain cleaning cable 510. In other embodiments, the working implements 524 may be removably coupled to the drain cleaning cable 510 by a connector (such as the connectors described herein).

Having a working implement 524 on each end of the cable 510 enables a user to reverse the cable 510 when desired. For example, if the cable 510 includes two different types of working implement, a user may reverse the cable in order to use a different type of working implement 524. Similarly, if one of the working implements 524 gets damaged, a user can reverse the cable 510 and continue cleaning debris from a drain or conduit. Accordingly, the drain cleaning cable 510 is adjustable between a first orientation (i.e., a standard orientation) and a second orientation (i.e., a reverse orientation). In the first orientation the first working implement 526*a* is configured to be inserted into a drain and the second working implement 526*b* is configured to be coupled to a drum of a drain cleaner, in the second orientation the first working implement 526*a* is configured to be coupled to a drum of a drain cleaner and the second working implement 526*b* is configure to be inserted into a drain.

It should be understood by a person of ordinary skill in the art that the embodiments disclosed herein are not exclusive and can be combined with other embodiments discussed herein. For example, the embodiments described with respect to FIGS. 12-16 or the embodiments described with respect to FIGS. 17-21 can include a hollow wire, as described in the embodiments illustrated in FIGS. 8-9. Likewise, the specific parameters disclosed with respect to a single embodiment may be combined with parameters disclosed with respect to another embodiment.

What is claimed is:

1. A drain cleaning cable for use with a drain cleaner including a rotatable drum, the drain cleaning cable comprising:

an inner core having a first end and a second end;

an outer wire concentrically surrounding the inner core, the outer wire helically wound in a first direction to form a plurality of consecutive coils, the outer wire having a first end and a second end; and a first connector engaging with the first end of the inner core and the first end of the outer wire, wherein the first connector is configured to attach the drain cleaning cable to a drain cleaning element, wherein the second end of the inner core and the second end of the outer wire are adapted to be received within the rotatable drum of the drain cleaner, and wherein the inner core includes an inner wire that is helically wound to have a pitch of between 2 and 8 mm and has a wind gap of between 1 and 5 mm, and wherein the outer wire has a pitch of between 6 and 12 mm and has a wind gap between 2 and 7 mm wherein the inner core weighs between 2 and 10 pounds per 50 feet and the outer wire weighs between 15 and 30 pounds per 50 feet.

2. The drain cleaning cable of claim 1, wherein the inner wire is helically wound in a second direction opposite to the first direction.

3. The drain cleaning cable of claim 1, wherein the first connector includes a cylindrical body and a connecting element, the cylindrical body configured to receive the first end of the inner core and the first end of the outer wire.

4. The drain cleaning cable of claim 3, wherein the cylindrical body forms a bore, and wherein the inner core is received within the bore.

5. The drain cleaning cable of claim 4, wherein the outer wire wraps around an outer circumference of the cylindrical body.

6. The drain cleaning cable of claim 3, wherein at least one of the inner core and the outer wire is threadably engaged with the cylindrical body of the first connector.

7. The drain cleaning cable of claim 1, further comprising a second connector engaging with the second end of the inner core and the second end of the outer wire.

8. The drain cleaning cable of claim 7, wherein the first connector includes a female connecting element and the second connector includes a male connecting element.

9. The drain cleaning cable of claim 1, wherein at least one of the inner core and the outer wire is coupled to the first connector by a method selected from the group consisting of crimping, staking, welding, and brazing.

10. The drain cleaning cable of claim 1, wherein the first connector includes a sleeve crimped to the first end of the inner core, and wherein the sleeve abuts a narrow portion of the outer wire.

11. The drain cleaning cable of claim 1, wherein at least one of the inner core and the outer wire has an open wind in which a gap exists between consecutive coils of the respective wire.

12. The drain cleaning cable of claim 1, wherein the outer wire is configured to collapse onto the inner core.

13. The drain cleaning cable of claim 1, wherein the inner core has a spring rate of between 0.5 and 1.5 N/mm and a torsion rate of between 20 and 75 N-mm/rev for a 50 foot cable, and wherein the outer wire has a spring rate of between 1.0 and 1.4 N/mm and a torsion rate of between 425 and 475 N-mm/rev for a 50 foot cable.

14. The drain cleaning cable of claim 1, wherein at least one of the inner core and the outer wire is heat treated.

15. The drain cleaning cable of claim 1, wherein the inner core is composed of at least one of nylon and high density polyethylene, and wherein the outer wire is composed of at least one of the materials included in the list consisting of steel, copper, aluminum, alloys, and brass.

16. A drain cleaning cable for use with a drain cleaner including a rotatable drum, the drain cleaning cable comprising:

an inner core having a first end and a second end, the inner core having a helically wound inner wire;

an outer wire concentrically surrounding the inner core, the outer wire helically wound in a first direction to form a plurality of consecutive coils, the outer wire having a first end and a second end; and a first connector engaging with the first end of the inner core and the first end of the outer wire, wherein the first connector is configured to attach the drain cleaning cable to a drain cleaning element, wherein the second end of the inner core and the second end of the outer wire are adapted to be received within the rotatable drum of the drain cleaner, and wherein the inner wire has a first non-zero wind gap, and wherein the outer wire has a second non-zero wind gap that is different from the first wind gap.

17. The drain cleaning cable of claim 16, wherein the inner core weighs between 2 and 10 pounds per 50 feet and the outer wire weighs between 15 and 30 pounds per 50 feet.

18. A drain cleaning cable for use with a drain cleaner including a rotatable drum, the drain cleaning cable comprising:

an inner core having a first end and a second end;

an outer wire concentrically surrounding the inner core, the outer wire helically wound in a first direction to form a plurality of consecutive coils, the outer wire having a first end and a second end; and a first connector engaging with the first end of the inner core and the first end of the outer wire, wherein the first connector is configured to attach the drain cleaning cable to a drain cleaning element, wherein the second end of the inner core and the second end of the outer wire are adapted to be received within the rotatable drum of the drain cleaner, and wherein the inner core has a spring rate of between 0.5 and 1.5 N/mm and a torsion rate of between 20 and 75 N-mm/rev for a 50 foot cable, and wherein the outer wire has a spring rate of between 1.0 and 1.4 N/mm and a torsion rate of between 425 and 475 N-mm/rev for a 50 foot cable.

19. The drain cleaning cable of claim 18, wherein the inner core weighs between 2 and 10 pounds per 50 feet and the outer wire weighs between 15 and 30 pounds per 50 feet.

20. The drain cleaning cable of claim 18, wherein the inner core includes an inner wire that is helically wound in a second direction opposite to the first direction.

* * * * *